US008479874B2

(12) United States Patent
Moretón Cesteros

(10) Patent No.: US 8,479,874 B2
(45) Date of Patent: Jul. 9, 2013

(54) ACOUSTIC ENCLOSURE FOR LOUDSPEAKERS

(76) Inventor: Ángel Julio Moretón Cesteros, Madrid (ES)

( * ) Notice: Subject to any disclaimer, the term of this patent is extended or adjusted under 35 U.S.C. 154(b) by 0 days.

(21) Appl. No.: 13/640,918

(22) PCT Filed: May 3, 2010

(86) PCT No.: PCT/ES2010/000191

§ 371 (c)(1),
(2), (4) Date: Dec. 22, 2012

(87) PCT Pub. No.: WO2011/138468

PCT Pub. Date: Nov. 10, 2011

(65) Prior Publication Data

US 2013/0105244 A1 May 2, 2013

(51) Int. Cl.
*A47B 81/06* (2006.01)

(52) U.S. Cl.
USPC ..... 181/199; 181/148; 181/198

(58) Field of Classification Search
USPC ..... 181/198, 199, 148
See application file for complete search history.

(56) References Cited

U.S. PATENT DOCUMENTS 6,141,428 A * 10/2000 Narus ..... 381/338
6,339,649 B1 * 1/2002 Chen et al. ..... 381/335
6,648,098 B2 * 11/2003 Nichols ..... 181/193
7,584,820 B2 * 9/2009 Parker et al. ..... 181/155
8,146,707 B2 * 4/2012 Choi et al. ..... 181/225
2003/0150668 A1 * 8/2003 Nichols ..... 181/193
2009/0173567 A1 * 7/2009 Stiles ..... 181/148

FOREIGN PATENT DOCUMENTS

ES 1059376 U 4/2005
GB 2 301 717 A 12/1996
GB 2 310 104 A 8/1997
JP 2008/160780 A 7/2008
WO WO 2006/043813 A1 4/2006

OTHER PUBLICATIONS

International Search Report, Jan. 27, 2011, from International Phase of the instant application.

* cited by examiner

*Primary Examiner* — Forrest M Phillips
(74) *Attorney, Agent, or Firm* — Jackson Patent Law Office

(57) ABSTRACT

Acoustic enclosure for mounting loudspeakers (1) that contains a certain number of curved-profile guides (8) arranged radially beside one another at a specific distance and forming a ring (7), between which the sound from the loudspeaker is propagated from the central space (6) to the outer ring (9), which it enters obliquely as a result of the curvature of the guides. Since said ring (9) contains no elements against which the sound can be reflected back into the conduits, it works like a closed circuit or track that the sound passes through until it is exhausted, keeping the inner face of the membrane of the loudspeaker free of disturbances that, in conventional enclosures, are caused by the reflected sound when it hits the membrane during the lifetime of the sound, thereby eliminating the distortion and alterations of the natural response linearity of the loudspeaker from this source.

3 Claims, 3 Drawing Sheets

ACOUSTIC ENCLOSURE FOR LOUDSPEAKERS

FIELD OF TECHNOLOGY

The invention belongs to the technical field of speakers for reproduction of sound.

PRIOR ART

In systems designed for reproduction of sound, speakers are the component that produces major alterations in the musical information.

Except for loudspeakers of electrostatic type, which project into the listening room the sound generated by the two surfaces of their membrane, both the most economical commercial speaker and the one of highest quality and price make use of boxes with an inner space or enclosure of a particular volume, where the loudspeaker projects the sound generated by the inner surface of its membrane.

This sound reverberates in chaotic fashion inside the enclosure and during its dwell time there it re-impinges in part on the membrane of the loudspeaker, perturbing its mode of vibration and generating distortion and alterations in the natural linearity of the frequency response of the sound projected into the room.

To reduce these perturbations, one uses enclosures of various shapes and installs sound-absorbing materials of various type inside them, which attenuate the intensity of the reverberating sound and reduce its dwell time.

As examples of enclosure designs we can mention those of Bowers & Wilkins (B&W) MATRIX and NAUTILUS, and as examples of the application of sound-absorbing material we can mention the Utility Model ACOUSTIC TREATMENT FOR HIGH-FIDELITY BAFFLES of Spanish patent U200502611.

The speakers produce distortion and alterations in the linearity of their sound with levels that are acceptable, but much worse than the rest of the components of the sound system, so that it is still today the goal to come closer to the latter.

Although there is an abundant literature and research on speakers with different types of enclosure, the applicant is unaware of the existence of antecedents or studies performed on enclosures of the type proposed.

DESCRIPTION OF THE INVENTION

Figure 1:
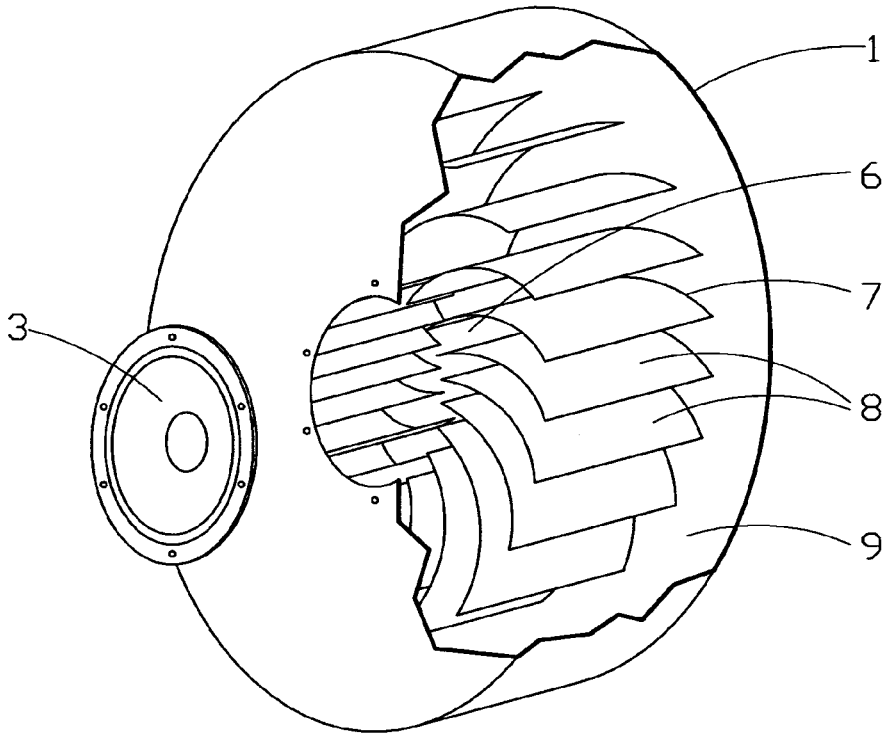
FIG. 1 is schematic view of an enclosure of cylindrical shape.

The present invention refers to an enclosure for installation in loudspeakers, in which the sound projected into it is not reflected in the direction of the loudspeaker itself.

1. Acoustic enclosure for installation of loudspeakers (1), characterized in having its interior space distributed in three parts, the first part or central space (6) which is in contact with the inner surface of the loudspeaker membrane (3) and receives its sound, the second part of guide ring (7), which surrounds the central space (6) in the form of a ring and contains a certain number of sound guides or plates (8) of curved profile, distributed radially one alongside the other, maintaining a certain distance or interval between each other, between which the sound propagates from the central space (6) to the third part, or outer ring (9), which also surrounds the guide ring (7) in the form of a ring, where said sound is introduced in an oblique direction, owing to the curvature of the guides (8).

FIG. 1 shows as an example and in schematic form a view of an enclosure (1) of cylindrical shape, the loudspeaker (3), which is represented as disassembled, the central space (6), the space corresponding to the guide ring (7), a set of equal guides (8), of curved profile, arranged radially one alongside the other at an interval of 20 degrees, and the space corresponding to the outer ring (9). A section has been drawn, omitting the sound-absorbing material for better clarity.

Figure 2:
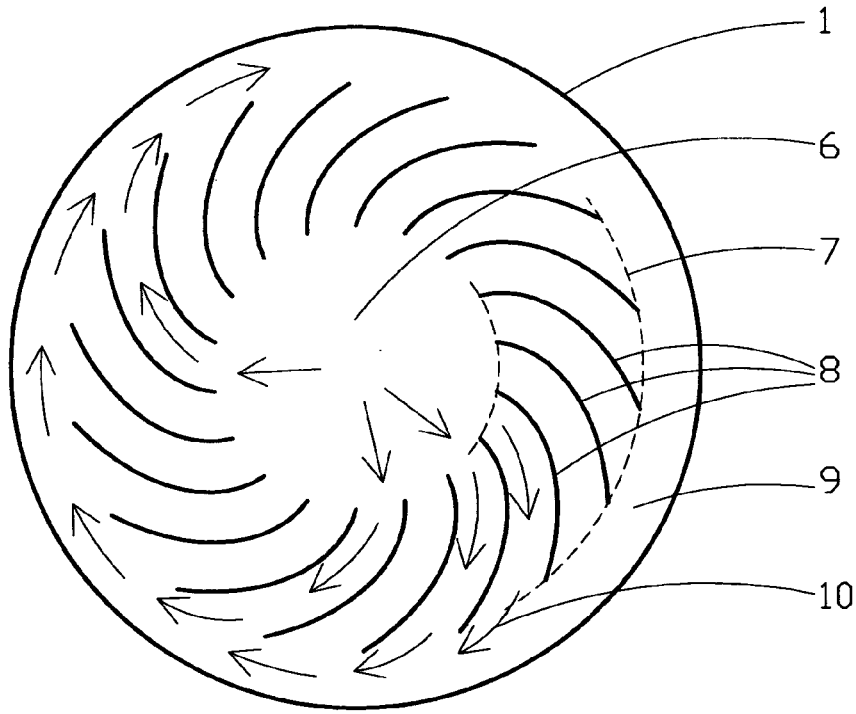
FIG. 2 is a front view of the enclosure of FIG. 1.

FIG. 2 shows as an example and in schematic form a front view of the enclosure (1) of FIG. 1, in which the loudspeaker, the front plate, and the sound-absorbing material has been omitted for better clarity, where one can see the central space (6), the guide ring (7), the 18 guides (8), the outer ring (9), and the trajectory of sound, represented by arrows (10).

Mode of Operation:

The sound emitted by the loudspeaker to the inside of the enclosure invades the central space (6), from which it is introduced inexorably between the guides (8), through which it propagates to the outer ring (9).

The oblique direction of entry of the sound in the outer ring (9), close to the tangential direction, due to the curvature of the guides, means that the sound travels in a single direction. Due to the fact that no element is present in said outer ring (9) where the sound could be reflected in the opposite direction, so as to return and enter the conduits, it acts like a closed circuit or endless track which the sound travels during its entire dwell time.

In this way, once the sound produced by the loudspeaker leaves the membrane, it begins a travel with no return, so that said membrane remains free of the impinging of reflected perturbing sounds, thus eliminating the distortion and alterations of linearity of the natural frequency response of the loudspeaker due to resonance reinforcement and canceling out of this origin.

The proposed enclosure can be used with loudspeakers of any type and range, the only requirement being that they are open, that is, the inner surface of their membrane is exposed to the enclosure.

2. Acoustic enclosure for installation of loudspeakers (1) according to claim 1, characterized in that it contains in its central space (6) a piece of conical (11), (14) or pyramidal (15), (16) shape, located with its axis aligned with the center of the loudspeaker, its base being supported against the rear surface of the enclosure, and its vertex pointing toward the loudspeaker.

Figure 3:
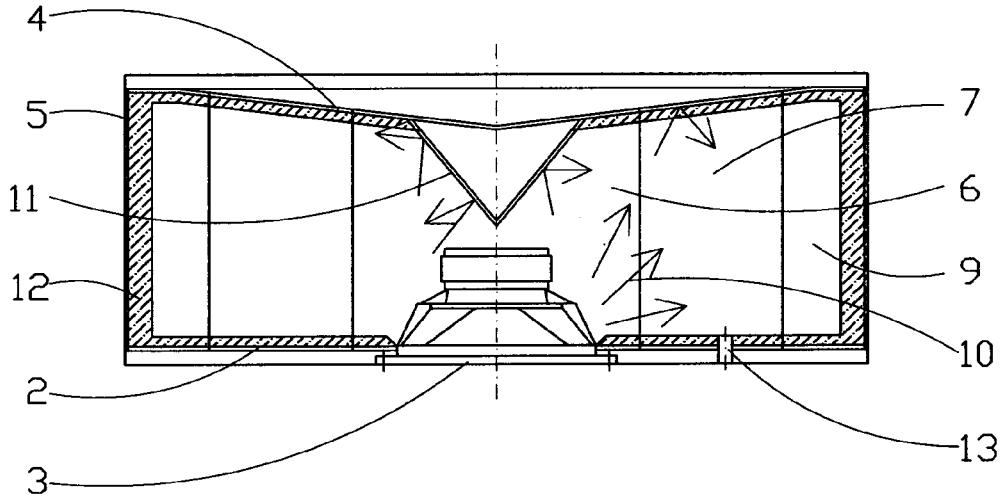
FIG. 3 is a section view of the enclosure of FIG. 1.

FIG. 3 shows as an example one structural form of the enclosure (1) of FIG. 1, in a section through the axis of the loudspeaker, where one can see the flat front plate (2), the loudspeaker (3), the rear plate (4), being slightly conical to avoid resonance, the structural rim (5) closing the enclosure, the central space (6), the guide ring (7), the outer ring (9), a conical piece (11), the sound-absorbing material (12), the trajectory of the sound, represented by arrows (10), and one of the 9 tuning apertures (13) which convert the closed enclosure into a bass reflex mode.

Figure 4:
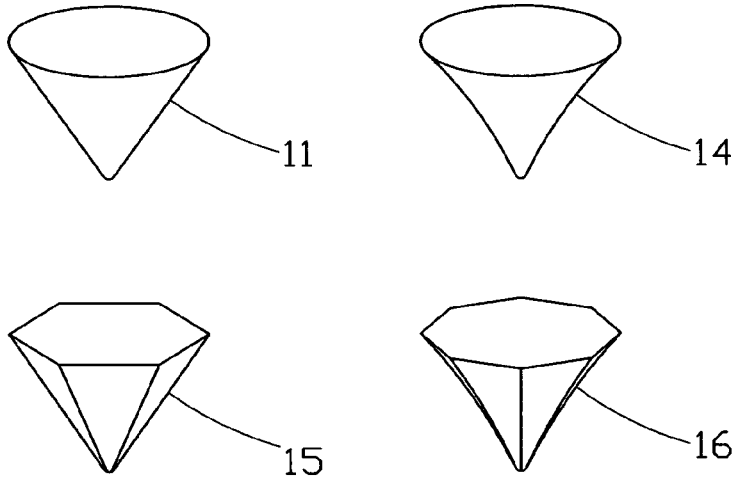
FIG. 4 shows exemplary pieces for installation in a central space.

Mode of Operation:

As can be seen in FIG. 4, the inclination of the surfaces of the conical piece (11) reflects the sound coming from the loudspeaker, directing its trajectory toward the guides and preventing some of the sound being reflected toward the loudspeaker in the central space.

FIG. 4 shows some examples of pieces suitable for installation in the central space (6), one piece of conical shape and circular base, with straight generatrices (11), one piece of conical shape and elliptical base, with curved generatrices (14), one piece of pyramidal shape and hexagonal base, with planar surfaces (15), and one piece of pyramidal shape and octagonal base, with curved surfaces (16).

3. Acoustic enclosure for installation of loudspeakers (1) according to previous claims, characterized in that it has a certain number of apertures (14) on one of its surfaces that connect the interior of the enclosure to the exterior.

Figure 5:
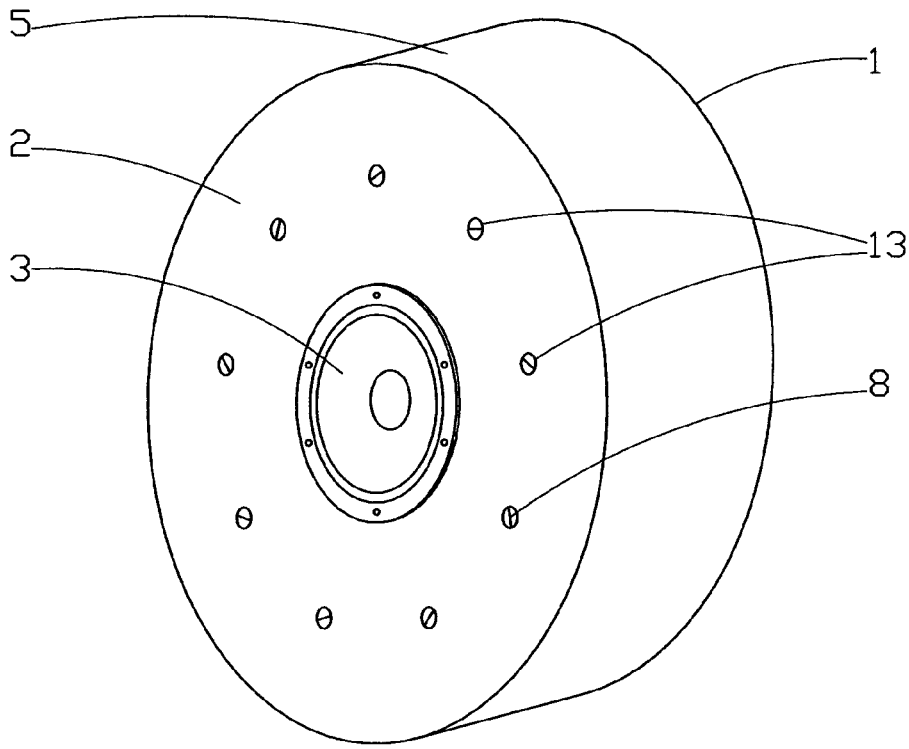
FIG. 5 is a perspective view.

FIG. 5 shows as an example a view of the enclosure (1), its front plate (2), the loudspeaker (3), its closing rim (5), 9 apertures (13) of circular shape made in its front plate (2), distributed with their center located on the guides (8), so that all the spaces between guides are connected to the outside via the middle of each aperture.

Mode of Operation:

In speakers intended for reproduction of low frequencies, the loudspeakers are often installed in enclosures known as a bass reflex, connected to the outside via one or more apertures or windows that adjust their resonance frequency to a value that reinforces, by acoustic interaction, the response of the loudspeaker at the low end of its frequency range.

The multiple apertures made in the proposed enclosure act in the same way, transforming the closed enclosure into a bass reflex.

EMBODIMENT

The example of the enclosure (1) shown in FIG. 3 can be embodied as follows:

- The plates (2) and (4) are made with slots coinciding with the location of the guides (8), so that one can use laser-cut aluminum sheet or fiberglass reinforced polyester.
- The guides (8) are assembled, for which one can use PVC or polycarbonate sheet, curved by thermal molding.
- A jig is prepared to mount the guide ring (7), where the plates (2) and (4) are placed in position, the guides (8) are introduced through the slots and attached to the plates by epoxy or polyester adhesive.
- The guide ring (7) is removed from the jig.
- The structural rim (5) is prepared, closing the enclosure, for which one can use turned aluminum sheet or a piece of polyester reinforced with fiberglass, preferably open.
- One prepares a piece of sound-absorbing material for each plate, for which one can use felt or open-cell polyurethane foam sheets, with cuts corresponding to the position of the sound guides, being introduced into the conduits and attached to the plates with contact adhesive.
- One prepares a piece of sound-absorbing material for the closing rim (5), and attaches it to its inner surface with contact adhesive.
- One opens the rim (5) slightly and installs it, closing the plates (2) and (4).
- One prepares the piece of conical shape (11) from cardboard or fiberglass reinforced polyester.
- One introduces it through the installation hole of the loudspeaker and attaches it by adhesive to the rear plate.
- One installs the loudspeaker.

The invention claimed is:

1. An acoustic enclosure for installation of a loudspeaker including a membrane defining an inner surface, the acoustic enclosure comprising:

an axis; and a plurality of sound guides distributed radially alongside each other, each sound guide defining a curved profile, each sound guide including a first end and a second end, a distance along each sound guide between the first and second ends defining an acute angular displacement about the axis, the plurality of sound guides defining a central space configured to be in contact with the inner surface of the loudspeaker membrane and to receive sound generated by the loudspeaker membrane, and a surrounding space surrounding the plurality of sound guides, the plurality of sound guides being configured to propagate sound from the central space and introduce sound at an oblique direction into the surrounding space owing to the curved profile of the plurality of sound guides.

2. The acoustic enclosure for installation of loudspeakers according to claim 1, further characterized in that it contains in its central space a piece of conical or pyramidal shape, located with its axis aligned with the center of the loudspeaker, its base being supported against the rear surface of the enclosure, and its vertex pointing toward the loudspeaker.

3. The acoustic enclosure for installation of loudspeakers according to claim 1, further characterized in that it has a certain number of apertures on one of its surfaces that connect the interior of the enclosure to the exterior.

* * * * *